US005378375A

United States Patent [19]

Bache

[11] Patent Number: 5,378,375

[45] Date of Patent: Jan. 3, 1995

[54] APPARATUS AND METHOD OF WASHING SCREENINGS

[75] Inventor: John C. Bache, Stourbridge, United Kingdom

[73] Assignee: Jones & Attwood Limited, Stourbridge, England

[21] Appl. No.: 18,186

[22] Filed: Feb. 16, 1993

[30] Foreign Application Priority Data

Feb. 15, 1992 [GB] United Kingdom ..... 9203269
Nov. 6, 1992 [GB] United Kingdom ..... 9223358

[51] Int. Cl.[6] ..... B01D 24/46

[52] U.S. Cl. ..... 210/772; 210/787; 210/208; 210/295; 4/DIG. 19

[58] Field of Search ..... 210/772, 787, 652, 208, 210/204, 202, 519, 220, 195.1, 195.4, 295, 767; 4/DIG. 19, 9

[56] References Cited

U.S. PATENT DOCUMENTS

| | | | |
|---|---|---|---|
| Re. 28,677 | 1/1976 | Blakley et al. | 241/46.08 |
| 2,404,215 | 7/1946 | Cavanaugh | 210/772 |
| 2,794,832 | 6/1957 | Rietema | 210/772 |
| 3,300,047 | 1/1967 | Hirsch | 210/208 |
| 4,288,329 | 9/1981 | Duval | 210/772 |
| 4,650,579 | 3/1987 | Harvey et al. | 210/208 |
| 4,999,115 | 3/1991 | Peterson | 210/202 |
| 5,080,797 | 1/1992 | Völkner | 210/652 |
| 5,132,027 | 7/1992 | Ukawa et al. | 210/787 |

FOREIGN PATENT DOCUMENTS

| | | |
|---|---|---|
| 0244765 | 11/1987 | European Pat. Off. . |
| 3217982 | 12/1983 | Germany . |
| 4042167 | 7/1991 | Germany . |
| 1482266 | 8/1977 | United Kingdom . |

*Primary Examiner*—Robert A. Dawson
*Assistant Examiner*—Ana M. Fortuna
*Attorney, Agent, or Firm*—Jacobson, Price, Holman & Stern

[57] ABSTRACT

A washing apparatus for washing solid fractions such as screenings or grit derived from a sewage treatment plant and contaminated with fecal material, such as fecal solids, includes a tank (11/111) for receiving aqueous liquid and the contaminated solid fractions, and mechanisms (23, 26, 126) for generating turbulence of the aqueous liquid in the tank to break-down the fecal contaminants. The method of washing screenings includes adding aqueous liquid and screenings contaminated with fecal material to a tank, subjecting the liquid containing contaminated screenings to turbulence to break down the fecal material and adding further liquid alone or containing screenings to the tank such that screenings and aqueous liquid containing finely divided fecal material flow from the tank over a weir or the like for dewatering and compaction of the screenings.

20 Claims, 5 Drawing Sheets

FIG 7
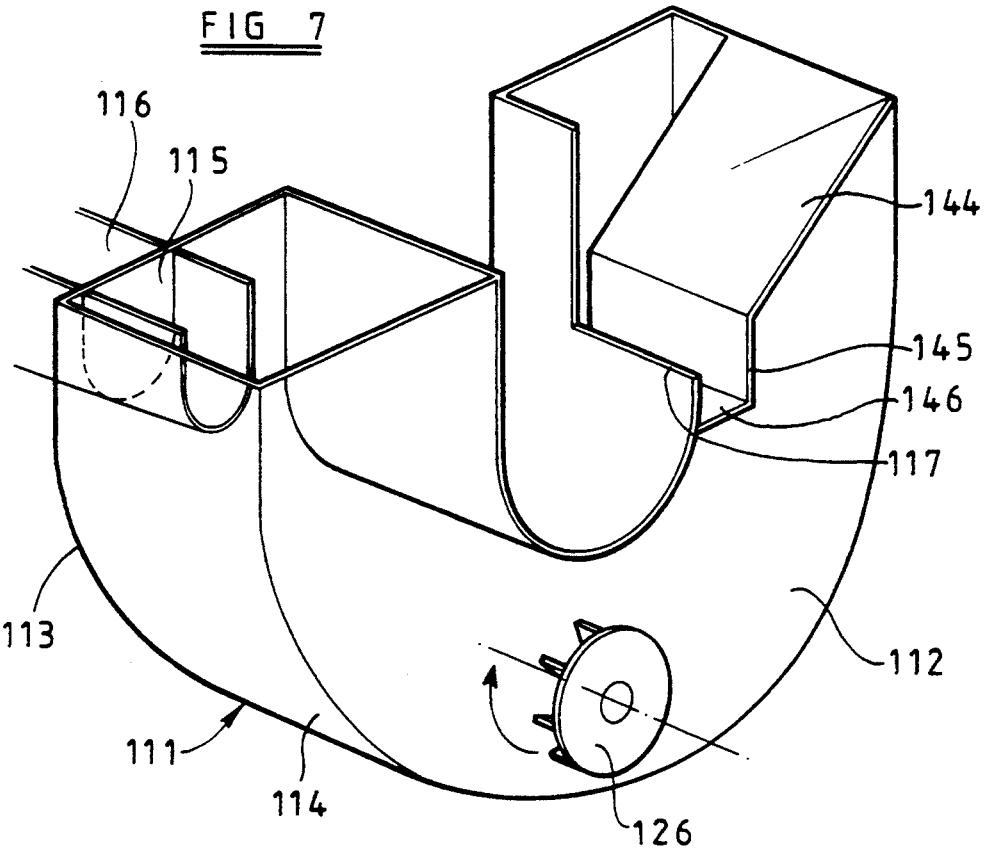
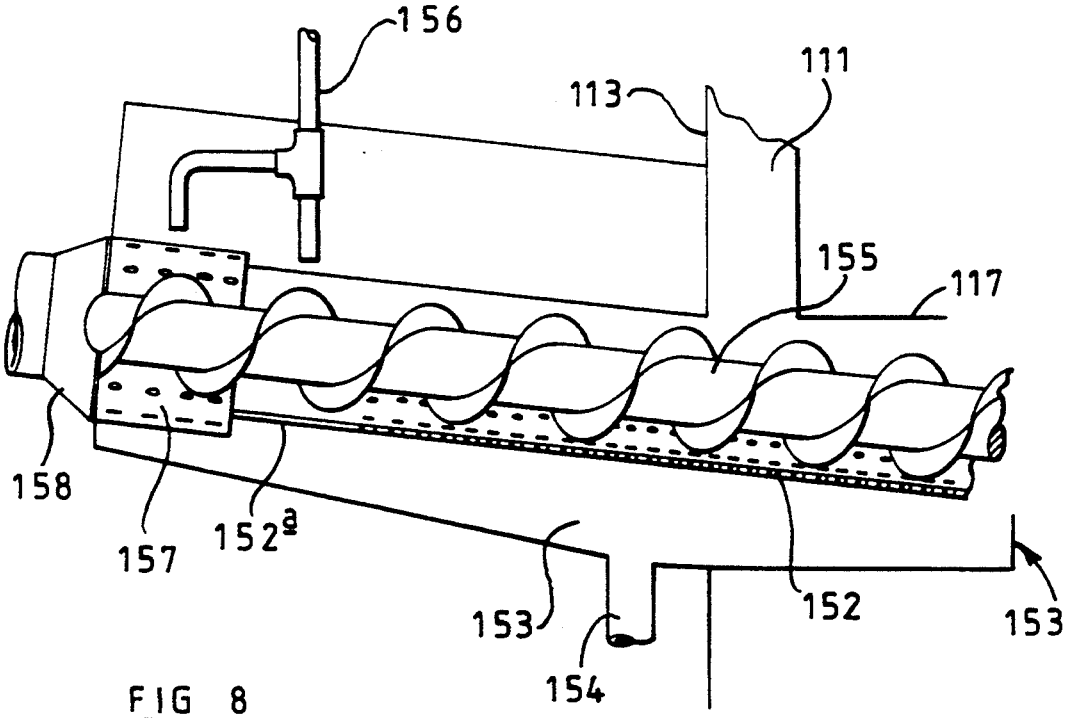
FIG 8

APPARATUS AND METHOD OF WASHING SCREENINGS

BACKGROUND OF THE INVENTION

This invention relates to apparatus for washing solid fractions such as screenings and grit extracted from the effluent flow of a sewage treatment plant to remove contamination by fecal solids and so render such fractions suitable for re-use or disposal.

It is recognized that materials entering a sewage treatment plant contains solid materials such as rags, paper, polythene and other plastic sheeting and the like which cannot be processed by the treatment plant. Screens or sieves capture such solids from the flow entering the sewage treatment plant and are cleaned periodically, or continuously, to remove the captured screenings for disposal. In order to minimize potential health hazards, and to improve the working environment of personnel handling the screenings, it is desirable that the screenings are free from fecal solids. Inevitably fecal solids from the flow entering the sewage treatment plant become entrapped with the screenings and the usual method of 'cleaning' the screenings involves the total maceration of everything removed from the flow by the screens. During this process fecal solids are reduced in size to a larger extent than the screenings, and can thus pass through additional fine secondary screens to return to the main sewage flow, the macerated screenings being retained. It will be recognized however that maceration of all solids removed by the primary screens absorbs large amounts of energy. In addition some of the screenings will be reduced to a sufficiently small size as to pass through the secondary screens and thus some of the screenings join the main flow re-entering the sewage treatment plant. Moreover stones, and other hard objects can be carried by the flow and can be delivered to the maceration plant with the screenings. Such objects can seriously damage the cutting blades of the macerater and thus maceration to permit removal of fecal solids is expensive both in energy costs, and machinery maintenance costs.

A further disadvantage of maceration of the screenings is that it is generally more convenient to handle screenings for disposal in their whole state since this leads to easier compaction and de-watering of the screenings. However, maceration of fecal solids is advantageous since it liquifies or disintegrates the biodegradable solids thereby increasing their effective surface area and accelerating the subsequent biological treatment process.

BRIEF SUMMARY OF THE INVENTION

It is an object of the present invention to provide an apparatus for 'cleaning' screenings which achieves the benefits of total maceration while minimizing the disadvantages thereof.

While the invention has primary application to the "decontamination" of screenings, it can be utilized in relation to cleaning of other solid fractions such as contaminated grit collected at other parts of the treatment plant.

In accordance with the present invention there is provided a washing apparatus comprising a tank for receiving aqueous liquid and solid fractions from a sewage treatment plant contaminated with fecal material, and means for generating turbulence within the aqueous liquid to break-down the fecal contaminants.

Conveniently an abrasive surface is positioned within the tank such that the solid fractions and any fecal solids within the tank are driven against the abrasive surface by said turbulence, whereby mechanical attrition assists the break-down of the fecal contaminants.

Desirably turbulence within the tank is generated by a rotating impeller within the tank imparting a swirling motion to the tank content.

Alternatively a pump draws tank content from the tank and pumps it back into the tank, the pumping action providing turbulence assisting break-down of fecal contaminants, and the return flow from the pump into the tank providing turbulence within the tank.

Desirably the tank is arranged to be fed continuously and has an outlet in the form of a weir over which liquid containing screenings and finely comminuted fecal solids flow.

Preferably the apparatus includes a de-watering station receiving the output from said tank, the liquid phase of said output, including the finely comminuted fecal material, being separated from said solid fractions which are then collected.

Desirably where said solid fractions are screenings, said station includes a compactor for compacting washed and de-watered screenings.

Conveniently said tank is U-shaped and said station is disposed, at least in part, between the limbs of the U-shaped tank.

Desirably a diverter valve mechanism is provided in the pump output line for routing pump output either to the tank or to a de-watering station.

The invention further resides in a method of washing contaminated screenings or grit.

BRIEF DESCRIPTION OF THE DRAWINGS

The invention will now be described in detail with reference to the accompanying drawings wherein:

FIG. 7 is an enlarged diagrammatic perspective representation of the tank of FIG. 6;

FIG. 8 is an enlarged diagrammatic perspective representation of the screen compactor of FIG. 6; and;

DETAILED DESCRIPTION

Figure 1:
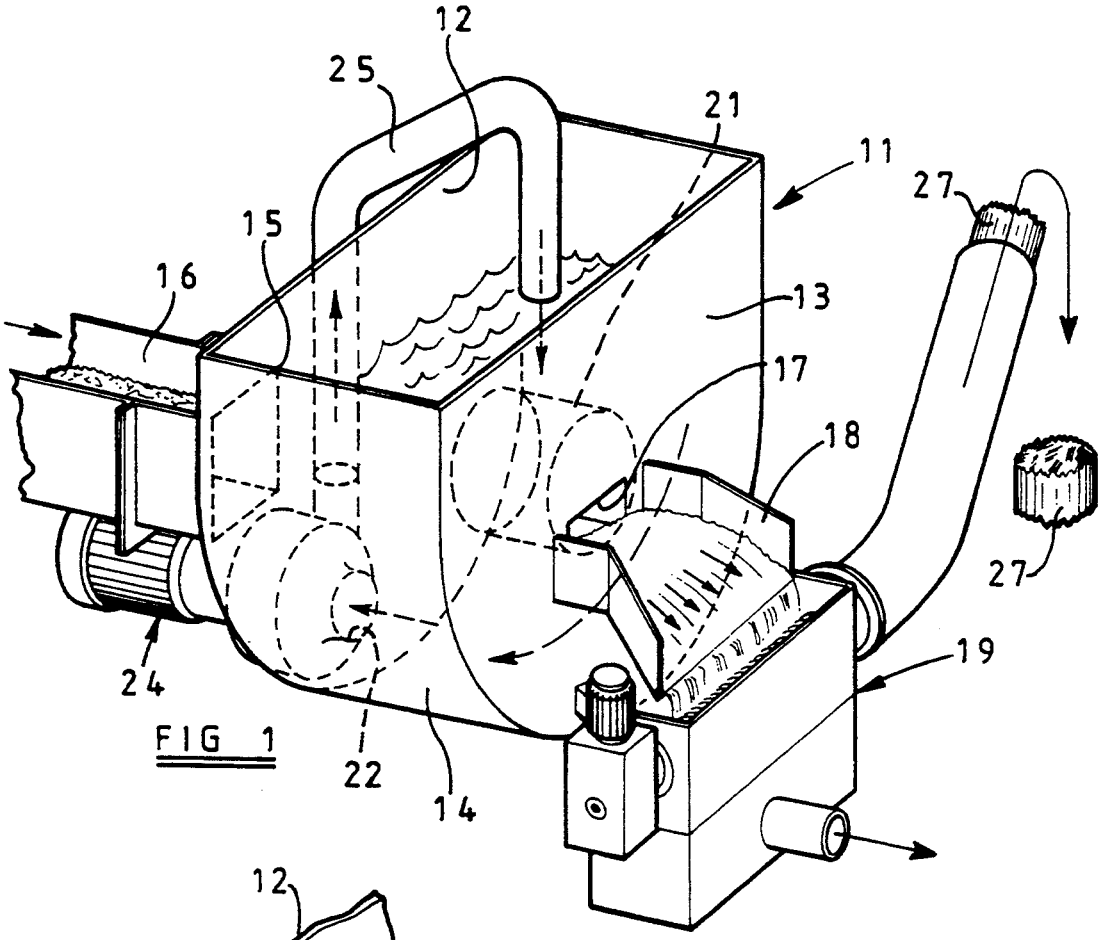
FIG. 1 is a diagrammatic, perspective view of a screenings washing apparatus in accordance with a first example of the present invention.
Figure 2:
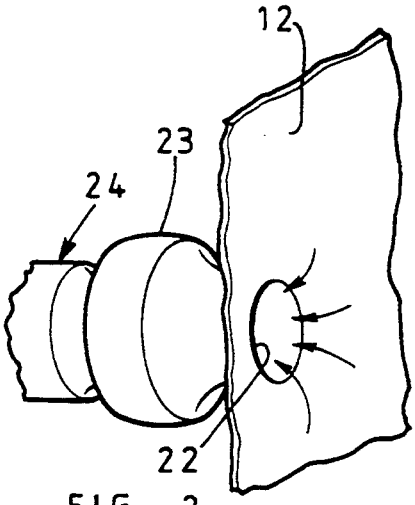
FIG. 2 an enlarged fragmentary perspective view of part of the apparatus of FIG. 1.

Referring first to FIGS. 1 and 2 of the drawings, the apparatus includes a tank 11 conveniently having parallel front and rear walls 12, 13 and a part cylindrical base wall 14. A rectangular inlet aperture 15 in the wall 12 communicates with a launder 16 along which screenings are carried by a water flow. It is not necessary for water which carries the screenings along the launder 16 and into the tank 11 to be clean water, and water free of solids derived from another part of the sewage treatment process can be utilized. As an alternative to the water-flushed launder 16 screenings could be conveyed to the tank 11 by other forms of conveyor, typically belt or screw conveyors, and the liquid phase necessary in the tank can be water piped from elsewhere in the sewage treatment plant.

The wall 13 of the tank is formed with a rectangular outlet aperture 17 the lowermost horizontal edge of which defines a weir. A metal channel 18 extending from the outer surface of the wall 13 guides the output flow from the weir into a de-watering and compaction station 19. Within the tank 11 a cylindrical tube 21 acts as a baffle controlling the flow of material from the tank to the weir.

A circular opening 22 in the wall 12 of the tank, adjacent the lower most point of the tank, defines an inlet into the pumping chamber 23 of an electrically driven rotary pump 24 (see FIG. 2). The pump 24 includes a high speed rotary impeller recessed into one wall of the chamber 23, and the arrangement is such that when the pump is operating the chamber 23 is in effect a large vortex flow chamber having a large diameter inlet by way of the aperture 22. The tangential outlet of the pumping chamber 23 is coupled to a large diameter pipe 25 which directs the output of the pump back into the tank adjacent an end wall thereof.

Primarily screenings to be washed in the apparatus are derived from the primary screens, or sieves, positioned at the inlet of the sewage treatment plant. Thus the raw flow containing rags, paper, plastic sheeting and the like encounters the primary screens upon entering the sewage treatment plant from the sewage collection system. The rags, paper, plastic sheeting and the like are intercepted by the primary screens to be removed therefrom for disposal. Inevitably, however, fecal solids, which the sewage treatment plant is intended to process, become entrapped with the screenings and get carried with the screenings when the screens are cleaned. Such entrapped fecal solids must be removed before the screenings can be disposed of, since they are both unpleasant for operatives handling the screenings, and may present a health hazard.

The screenings entering the tank 11 are subjected to an intense swirling action within the tank generated by the flow of material being pumped out of the tank through the aperture 22 and back into the tank from the pipe 25. The swirling motion of the liquid within the tank assists in breaking fecal solids into a finely comminuted form. Moreover, the passage of the fecal solids with the liquid phase and screenings through the pumping chamber 23 also assists comminution of the fecal solids. It will be understood that the high rotational speed of the impeller acting upon the content of the chamber 23 causes variable vortex forces to be generated within the chamber thus imparting shear forces to the solids within the chamber.

As a further aid to comminution of the fecal solids the inner surface of the tank 11 may be provided with an abrasive lining so that as fecal solids are thrown against the wall of the tank by the turbulent flow within the tank mechanical attrition of the fecal solids occurs. The abrasive lining of the tank 11 could be achieved in a number of different ways. For example, a metallic or ceramic particle based abrasive coating could be applied to the tank walls, so as to adhere directly to the walls, or alternatively could be applied to lining panels secured to the tank inner wall by separate fixing devices. As an alternative the walls could be lined with perforated metal plates, conveniently of the type known as 'EXPAMET'.

It will be recognized therefore that within the washing apparatus there may be three separate mechanisms whereby fecal solids are "liquified", that is to say comminuted or disintegrated. Firstly there is the effect of pumping in which shear forces are applied to the liquid and the fecal solids carried by the liquid within the pumping chamber 23. Secondly, there is a similar effect achieved by the swirling motion of the turbulent flow within the tank 11, and thirdly there is mechanical attrition produced by fecal solids impacting against one another, possibly the impeller of the pump, other solid material within the tank, and, if provided, the abrasive surfaces of the tank.

Figure 3:
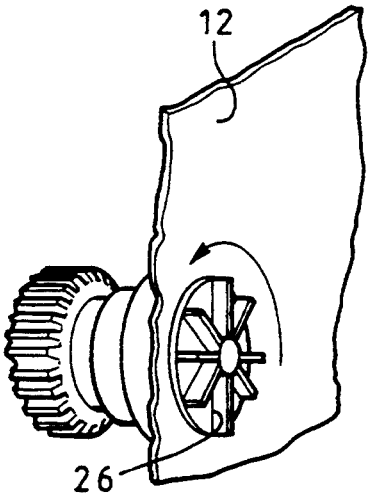
FIG. 3 is a view similar to FIG. 2 of a modification.

It is possible that in some circumstances sufficient break-down of fecal solids could be achieved without the pumping action, and FIG. 3 illustrates a modification in which the pump 24 and pumping chamber 23 are omitted. An electrically driven, high speed, rotary impeller 26 is recessed in, or positioned adjacent, the inner wall 12 of the tank and generates the turbulent swirling flow within the tank. Moreover, given adequate processing time it is probable that sufficient comminution of the fecal solids would occur without the use of an abrasive surface in the tank, but clearly the use of an abrasive surface can accelerate the rate of break-down of the fecal solids.

It is preferred to supply screenings to the tank 11 on a continuous basis by way of the water flushed launder 16 so that there is a continuous input of liquid phase, and screenings. However, if screenings are conveyed to the tank in some other way, either on a continuous basis or in discrete batches, water will nevertheless be applied continuously, or at least substantially continuously. Thus there will be a substantially continuous flow of the tank content over the weir. Screenings will be carried over the weir with the flow, but large fecal solids will not. The finely comminuted fecal material will flow over the weir with the liquid phase, and thus the liquid phase containing finely comminuted fecal material and screenings will flow along the channel 18 and into the de-watering and compacting station 19.

Within the station 19 a sieve retains the screenings, but permits the liquid phase together with finely comminuted fecal material to pass to an outlet from which the liquid phase is returned to the main effluent flow of the sewage treatment plant. The compactor of the station 19 is conveniently a screw compactor which compresses the screenings to squeeze any liquid therefrom, and then discharges the screenings as solid blocks 27 of 'white' screenings for disposal.

Figure 4:
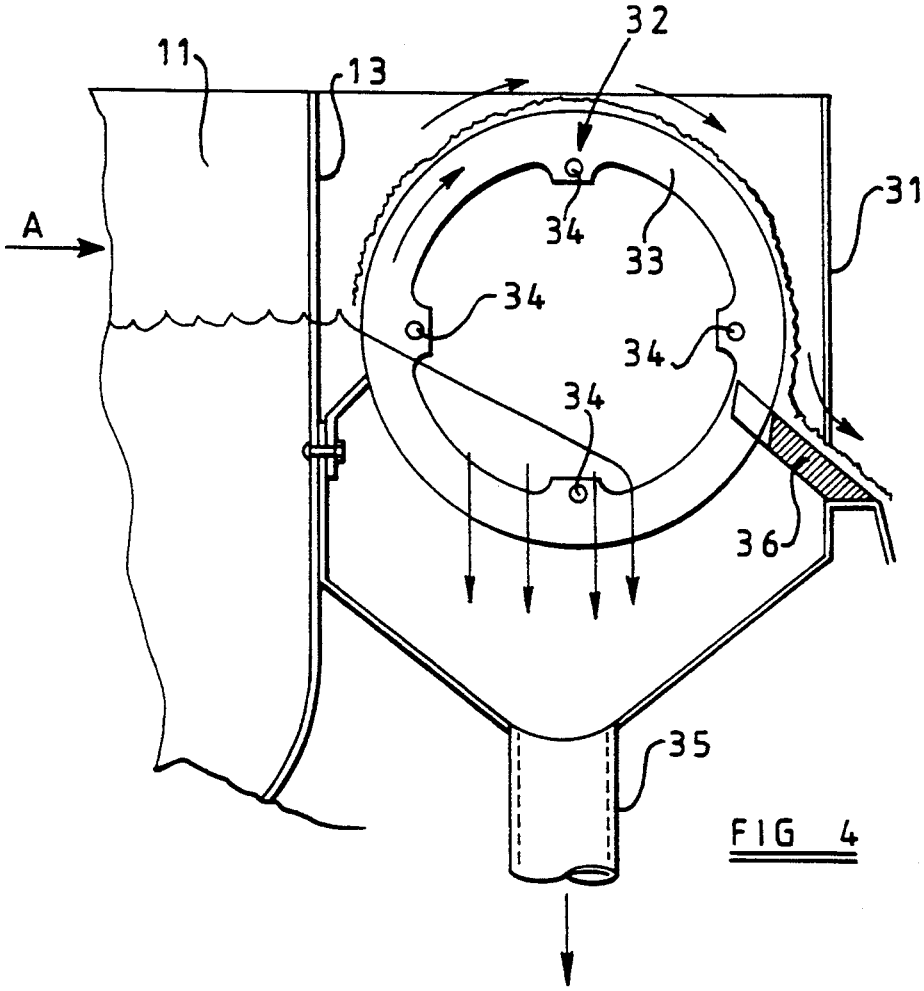
FIG. 4 is a side elevational view, partly in cross section, of a mechanical separator which may be utilized in place of the weir outlet of the apparatus of FIG. 1.

There may be circumstances, for example where a high liquid flow rate is required, where undesirably large pieces of fecal solids may be carried over the weir. Such pieces would be retained by the sieve of the station 19 and thus would contaminate the compacted screenings. In order to prevent such an occurrence a drum screen arrangement of the kind illustrated in FIG. 4 may be positioned at the weir outlet of the tank The drum screen arrangement includes a drum chamber 31 secured to the outer surface of the wall 13 of the tank 11 in a position enclosing the outlet aperture 17. In effect the drum chamber 31 replaces the channel 18. Within the chamber 31 is a cylindrical drum screen 32 rotatable about a horizontal axis by means of a conveniently positioned electrical drive motor. The drum 32 is defined by a plurality of spaced, parallel, identical annular discs 33 secured together by four equiangularly spaced axially extending rods 34. The two discs 33 at opposite axial ends respectively of the drum differ from the intervening discs in that they are solid, rather than annular, and in that they support outwardly extending coaxial shafts through which the drum is supported for rotation in bearings carried by the walls of the chamber 31. The outlet weir of the tank 11 is modified so as to be in close, or lightly touching contact with the periphery of the discs 33, the arrangement being such that the whole of the outflow from the tank 11 must pass through the drum 32. The spacing between the discs 33 is sufficiently small that no fecal solids can pass therebetween. Moreover, the positioning of the rotational axis of the drum 32 is such, in relation to the maximum liquid level within the tank 11, that the outflow from the tank impinges upon a substantially vertically orientated part of the drum.

In use the drum 32 is rotated in a direction such that an upwardly moving surface is presented to the outflow from the tank 11. Screenings such as rags, paper, plastic sheet and the like will adhere to the peripheries of the discs 33 and will be carried upwardly away from the tank 11 by rotation of the drum 32. Liquid phase, containing finely comminuted fecal material can flow between the discs to an outlet 35 at the lower end of the drum chamber 31. Screenings carried by the drum will drain to some extent as they pass over the highest point of the drum, and will be removed from the drum at the side of the drum opposite the tank 11 by a scraper 36. Screenings removed from the drum by the scraper 36 will fall into a compacting and de-watering station similar to the station 19 of FIG. 1. Further liquid squeezed from the screenings in the station 19 will be returned to the main effluent flow with the liquid draining from the outlet 35. Fecal solids will not adhere to the substantially vertical face of the drum, and so will not be carried out of the liquid by the slowly rotating drum and instead will return to the tank 11 to undergo further disintegration under the action described above.

Periodically it will be necessary to remove hard solids such as stones and the like which collect in the low point of the tank 11.

Figure 5:
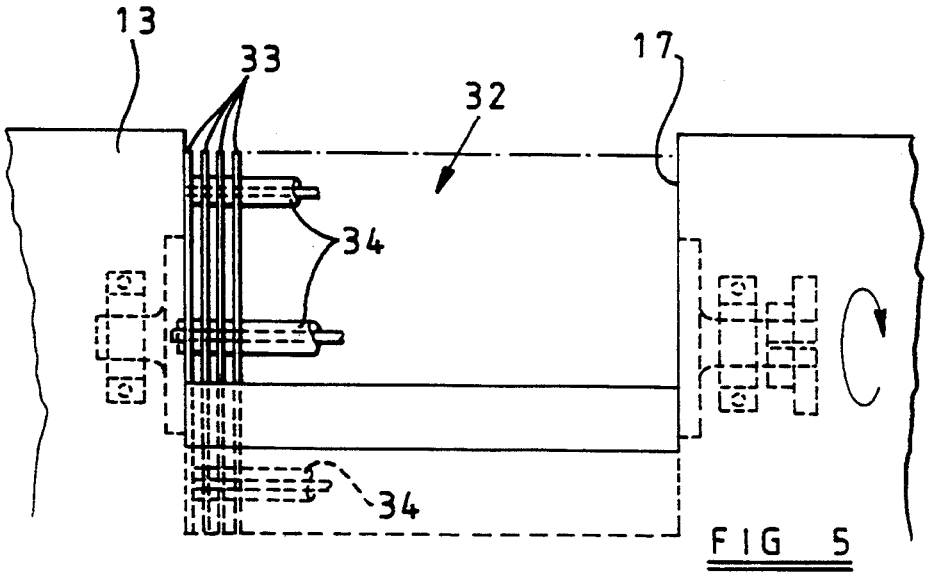
FIG. 5 is a view in the direction of arrow A in FIG. 4.

It will be recognized that drum screens of the kind described above with reference to FIGS. 4 and 5 may find use in applications other than the washing apparatus described above, for example one or more such drum screens could be used to separate screenings from the flow passing over a storm over-flow weir.

Figure 6:
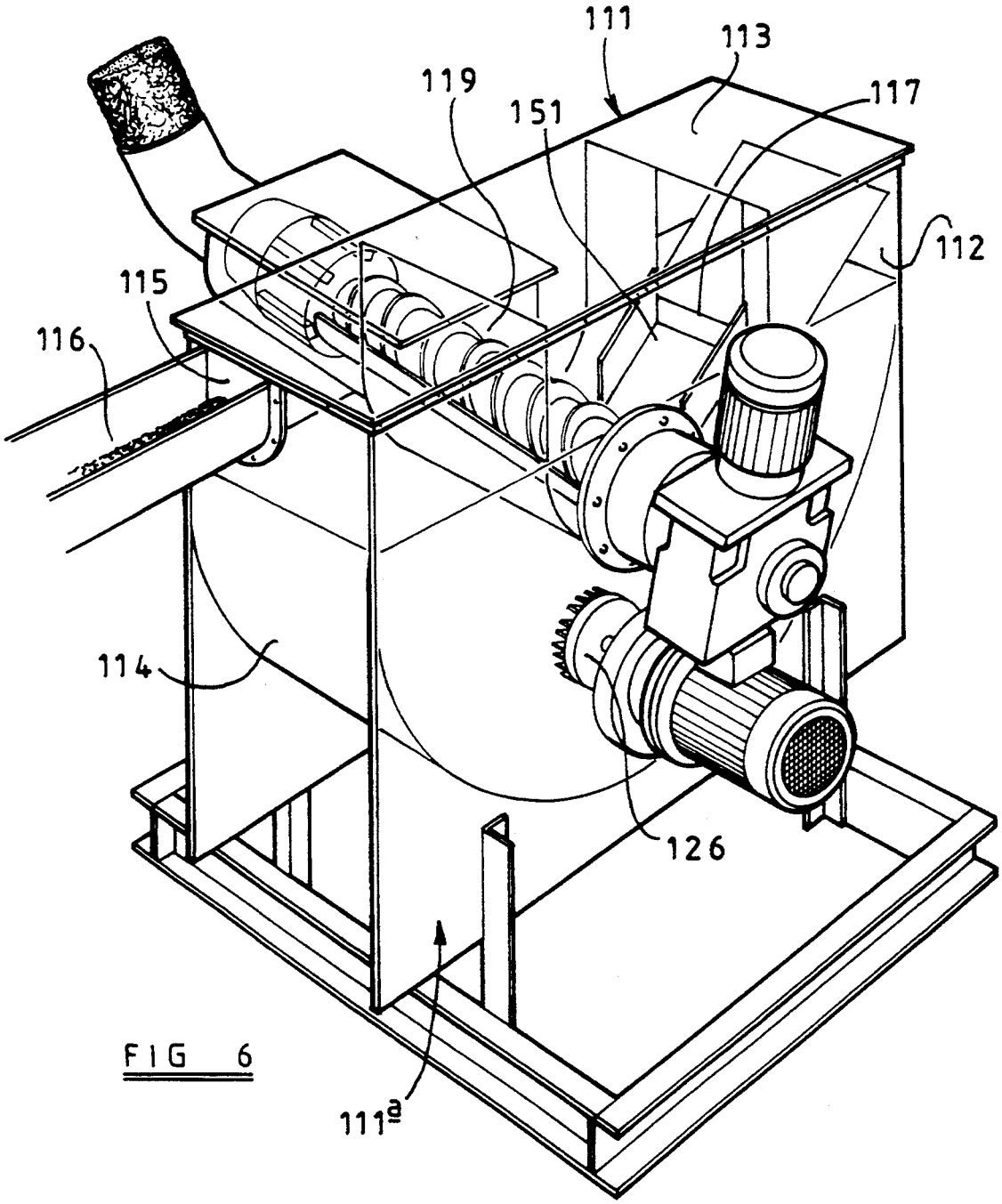
FIG. 6 is a view similar to FIG. 1 of a modification.

Referring now to FIGS. 6, 7 and 8 of the accompanying drawings the apparatus includes a U-shaped tank 111 supported on a metal frame 111*a*. The tank has parallel U-shaped front and rear walls 112, 113 and a part cylindrical base wall 114. Thus the tank comprises left and right spaced, upstanding, parallel limbs interconnected by a part cylindrical base region. A closable inlet aperture in the rear (FIG. 7) or side (FIG. 6) wall of the left hand limb is indicated by the reference numeral 115, the aperture 115 communicating with a launder 116 along which screenings are carried by a water flow into the tank as described above.

The outlet arrangement of the tank 111 differs from that described above in that rather than there being an outlet aperture and weir in the front wall of the tank, the outlet weir 117 of the tank 111 is defined by part of the inwardly presented wall of the right hand limb of the tank. Thus the outlet flow from the tank 111 passes over the weir 117 and into the space between the parallel limbs of the tank. In the arrangements described with reference to FIGS. 1 to 5 the de-watering and compaction station is positioned externally of the tank and a channel guides the outlet flow from the tank to the de-watering and compaction station. In the embodiment illustrated in FIGS. 6, 7 and 8 the de-watered and compaction station 119 lies partly within the space between the limbs of the tank as will be described in more detail hereinafter.

As is apparent from FIG. 7 part of the inwardly presented wall of the right hand limb of the tank is cut away to define the weir 117. Within the right hand limb of the tank there is positioned an inclined baffle plate 144 which inclines downwardly from the upper edge of the outermost wall of the tank towards the weir 117. However, short of the weir 117 the baffle plate 144 is formed with a vertically downwardly extending section 145 terminating in a horizontal section 146 which engages the inner wall of the right hand limb below the weir 117. The width of the baffle plate 144, 145, 146 is greater than the width of the weir 117 but less than the width of the right hand limb of the tank. The baffle thus prevents a direct flow of liquid to the weir, so minimizing the possibility of turbulent flow within the tank carrying uncomminuted fecal solids over the weir.

The turbulence within the tank is generated by means of an impeller 126 similar to that described with reference to FIG. 3. Impeller 12*e* is rotated by a motor as shown in FIG. 6 in the direction of rotation shown by the arrow in FIG. 7 to induce flow in the tank substantially toward the inlet 115 thereby minimizing flow of floating fecal material toward the right hand limb and the outlet weir 117. It will be understood however that if desired a pumping arrangement similar to that described with reference to FIGS. 1 and 2 could be used.

The de-watering and compaction station 119 extends through the gap between the parallel limbs of the tank 111 and the weir 117 discharges into the receiving region of the station 119, the outlet end of the station 119 protruding to the rear of the tank 111. The de-watering and screw compaction apparatus is inclined at a slope of at least 1:100 to encourage draining of the apparatus. The outlet flow from the weir 117 containing water, liquified fecal material, and washed screenings is directed by a chute 151 into the inlet region of the screw compactor 119 (see FIG. 8). The outlet flow from the weir enters the lower end of the screw compactor and the fouled water containing finally comminuted fecal material drains through the perforated trough 152 of the screw compactor to be collected in the drainage chamber 153 of the compactor, from where the liquid is directed through an outlet 154 for return to the main effluent flow of the sewage treatment plant. Screenings are retained by the trough 152 and are carried up the slope of the trough by the rotating screw 155 of the compactor 119. The action of moving the screenings by means of the screw 155 displaces some water from the screenings and adjacent the upper end of the trough 152 there is an unperforated region 152*a* above which is a clean water inlet 156. Clean water entering at this point showers the cleaned screenings to perform a final rinsing action, the rinse water washing out any polluting fecal material which may have been retained from the outlet flow from the tank. Draining from this point also occurs into the chamber 153. At the upper end of the screw compactor there is a de-watering chamber 157 having a restriction cone 158 into which the washed and rinsed screenings are driven by the screw 155, the cone causing compaction and final de-watering of the screenings. At the outlet end of the cone 158 there is an outlet chute for depositing the compacted "white" screenings into transportation skips or into a bagging system.

It will be recognized that in the unlikely event of larger pieces of fecal material being washed over the weir 117 then the action of the screw 115 driving the materials over the perforated trough 152 will finely comminute any such larger pieces of fecal material, and the comminuted material will be removed by the final rinse at the region 152*a*.

The washing apparatus described above can be utilized to "clean" screenings other than those retained by the primary screens of a sewage treatment plant. For example, a later phase in the sewage treatment plant involves settlement of finely comminuted fecal and other organic material as a sludge. In some treatment plants rags, papers, plastic sheet and the like which have escaped primary screening are separated from the flow entering the settlement phase of the treatment plant. The screenings removed for disposal at this may be contaminated with fecal material in the form of a black settlement slime or sludge and this can be removed by washing the screenings in apparatus as described above wherein the swirling turbulent washing action dislodges the contamination from the screenings, the water being returned to the settlement tank and the screenings being de-watered and compacted for disposal. It will be recognized that when washing screenings to remove such contamination the use of abrasive surfaces is unnecessary since mechanical attrition is not important to the breakdown of slime or sludge coatings on the screenings.

Settled sludge is next subjected to digestion and digested sludge can be used for agricultural purposes. However, small screenings which have escaped the primary screens as the screens at the primary settlement stage may be screened from the digested sludge before use of the sludge. Such screenings can be washed to remove adherent digested fecal slime and sludge as described above.

Figure 9:
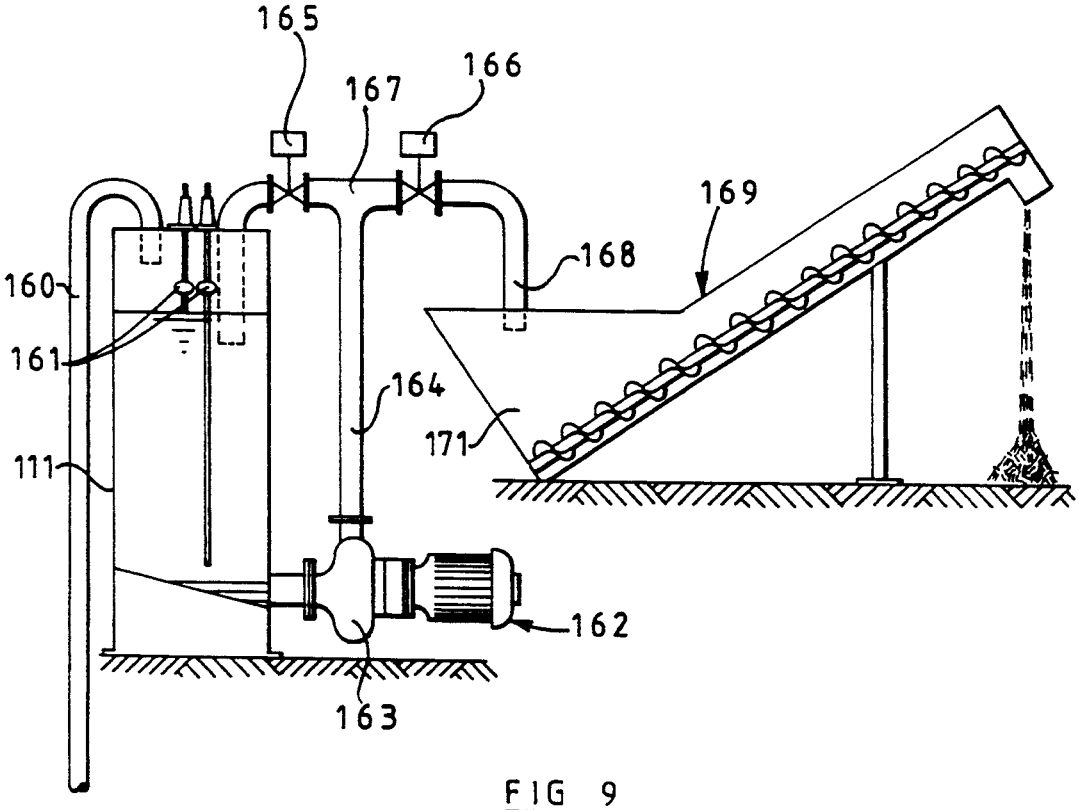
FIG. 9 is a schematic elevational view of a further modification to facilitate grit washing.

Furthermore it is to be recognized that while the washing of screenings is a particularly important aspect, the invention is not specifically restricted to washing screenings and with minor modifications the apparatus and process described above may find use in the washing of other solid fractions derived from the sewage treatment process, for example, contaminated grit derived from other parts of the sewage treatment plant. FIG. 9 illustrates such a modification.

Grit and water mixture may contain heavy contamination from fecal material either in the form of fecal solids, or in the form of a sludge, dependent upon the point in the sewage treatment process at which the grit is separated. Either form of fecal contamination produces an unacceptable grit product for disposal. In the apparatus illustrated in FIG. 9 a grit and water mixture is pumped from a grit removal system to a washing tank 111 similar to that described above, by way of a rising main 160. Level sensing electrodes 161 in the tank indicate full and empty levels within the tank respectively and supply control signals to control apparatus associated with the washing system. When the tank is full a grit pump 162 withdraws grit and liquid from a lower region of the tank 111 and pumps it, through a pump bowl 163 into a pump outlet pipe 164. A T-connection 167 at the end of the outlet pipe 164 has its two outlet limbs controlled by electrically operable valves 165, 166. While grit washing is in progress the pump 162 is operated and the valve 166 is closed while the valve 165 is open. Thus grit is recirculated into the tank 111 so that energy transfer in the pump bowl 163 and rapid recycling within the tank 111 creates a turbulence which liquifies any solid fecal material, or washes fecal sludge from the grit particles. After a predetermined time interval (determined by experience) the valve 165 is closed and the valve 166 opens so that the content of the tank 111 is pumped through a discharge pipe 168 into the inlet region 171 of a conventional inclined screw classifier 169. The liquid phase of the discharge entering the screw classifier 169 (which contains the finally comminuted or liquified fecal material) drains in the normal manner and is returned to the main effluent flow of the sewage treatment works. Grit is separated and de-watered by the classifier and delivered at the upper end of the screw classifier as cleaned grit for disposal.

It will be recognized that if desired the pumping and diverter valve arrangement described with reference to FIG. 9 could be applied to the washing of screenings, the discharge pipe 168 discharging into a remote de-watering and screw compaction station. Moreover where turbulence within the tank is generated by an impeller a pump system could be provided in place of or in conjunction with a gravity outlet arrangement for delivering the outlet flow to a remote de-watering-/compacting station.

There are occasions when the output from existing screening compactors and/or de-watering systems is not acceptable as a disposal product because of fouling by fecal materials remaining within the product. Such product may arise from conventional systems not having the effective washing described above and may be reprocessed in washing apparatus as described above to produce a product suitable for re-use or disposal.

I claim:

1. A washing apparatus for washing solid fractions derived from a sewage treatment plant and contaminated with fecal material comprising:

a substantially U-shaped tank for receiving and containing aqueous liquid and said contaminated solid fractions from a sewage treatment plant, said tank comprising a first upstanding leg portion, a second upstanding leg portion and a lower connecting portion connecting said leg portions at lower ends thereof;

an inlet for said aqueous liquid in said first leg portion;

an outlet in said second leg portion for discharging effluent from said tank; and means for generating turbulence of said aqueous liquid within said tank to break-down said fecal contaminants.

2. Apparatus as claimed in claim 1 and further comprising:

abrasive surface means disposed within said tank so that said turbulence generating means drives said solid fraction and any fecal solids within said tank against said abrasive surface means to produce mechanical attrition thereof and complement said breakdown of fecal contaminants.

3. Apparatus as claimed in claim 2 wherein:

said turbulence generating means comprises a rotating impeller within said tank for imparting a swirling motion to said aqueous liquid and solid fractions and any fecal solids in said tank.

4. Apparatus as claimed in claim 1 wherein:

said turbulence generating means comprises a rotating impeller within said tank for imparting a swirling motion to said aqueous liquid and solid fractions and any fecal solids in said tank.

5. Apparatus as claimed in claim 4 wherein:

said impeller is disposed in said lower connecting portion of said tank.

6. Apparatus as claimed in claim 1 wherein:

said turbulence generating means comprises pump means having a pump inlet communicating with the interior of said tank, a pump outlet, and a return means communicating with said pump outlet and said interior of said tank so that operation of said pump means produces a pumping action creating turbulence by flow of tank contents to and through said pump means and by said return means returning said pumped tank contents to said tank.

7. Apparatus as claimed in claim 6 wherein:

said return means comprises a pump output line, and diverter valve means in said pump output line for directing said flow of said tank contents from said pump outlet selectively to said tank or to a dewatering station.

8. Apparatus as claimed in claim 1 and further comprising:

means for continuously feeding said solid fractions and contaminated material to said tank inlet; and a weir at said tank outlet over which flows liquid containing at least one of solid fractions, screenings, and finely comminuted fecal material.

9. Apparatus as claimed in claim 1 and further comprising:

a de-watering station communicating with said tank outlet for receiving said effluent, separating the liquid phase including finely comminuted fecal material in said effluent from solid fractions in said effluent, and collecting said separated solid fractions.

10. Apparatus as claimed in claim 9 and further comprising:

compactor means communicating with said de-watering station for compacting washed and de-watered solid fractions from said apparatus.

11. Apparatus as claimed in claim 9 wherein:

a space is provided between said first and second leg portions;

said de-watering station is at least partly disposed in said space between said leg portions.

12. Apparatus as claimed in claim 10 wherein:

a space is provided between said first and second leg portions;

said de-watering station is at least partly disposed in said space between said leg portions.

13. Apparatus as claimed in claim 19 wherein:

said return means comprises a pump output line; and a diverter valve means is provided in said pump output line for directing said flow of said tank contents from said ump outlet selectively to said tank or to said de-watering station.

14. Apparatus as claimed in claim 10 wherein:

said compactor means is operatively connected to said dewatering station for receiving said solid fractions therefrom.

15. Apparatus as claimed in claim 1 wherein said turbulence generating means comprises:

a rotating impeller within said tank for imparting a swirling motion to said aqueous liquid and solid fractions and any fecal solids in said tank; and means for rotating said impeller in a direction to induce turbulent flow of said aqueous liquid and solid fractions therein substantially toward said inlet in said first leg portion.

16. Apparatus as claimed in claim 15 wherein:

said lower connecting portion of said tank comprises a part cylindrical base wall.

17. Apparatus as claimed in claim 15 wherein:

said impeller is disposed in said lower connecting portion of said tank.

18. Apparatus as claimed in claim 1 wherein:

said lower connecting portion of said tank comprises a part cylindrical base wall.

19. A method of washing screenings derived from a sewage treatment plant and contaminated with fecal material comprising:

providing a tank having an inlet, an outlet, and an interior;

providing a weir-type separating means in said outlet of said tank;

feeding aqueous liquid and screenings contaminated by fecal material to said interior of said tank;

producing turbulence to said liquid in said interior of said tank to subject said liquid containing said contaminated screenings to said turbulence to breakdown said fecal material;

adding at least one of further liquid and further liquid containing said screenings to said interior of said tank so that said screenings and aqueous liquid subjected to said turbulence and containing finely divided fecal material flow out of said tank over said weir separating means;

de-watering said effluent from said tank; and compacting said screenings in said effluent.

20. The method as claimed in claim 19 and further comprising:

separating said screenings from said liquid in said effluent prior to said compacting.

* * * * *